US011859616B2

(12) United States Patent
Martens et al.

(10) Patent No.: US 11,859,616 B2
(45) Date of Patent: Jan. 2, 2024

(54) MINIMUM PRESSURE VALVE AND METHOD FOR SERVICING SUCH A VALVE

(71) Applicant: ATLAS COPCO AIRPOWER, NAAMLOZE VENNOOTSCHAP, Wilrijk (BE)

(72) Inventors: Kristof Adrien Martens, Wilrijk (BE); Pieter De Schamphelaere, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 545 days.

(21) Appl. No.: 16/979,043

(22) PCT Filed: Oct. 2, 2018

(86) PCT No.: PCT/IB2018/057628
§ 371 (c)(1),
(2) Date: Sep. 8, 2020

(87) PCT Pub. No.: WO2019/186258
PCT Pub. Date: Oct. 3, 2019

(65) Prior Publication Data

US 2021/0054838 A1 Feb. 25, 2021

(30) Foreign Application Priority Data

Mar. 27, 2018 (BE) ..... 2018/5203

(51) Int. Cl.
*F04B 53/10* (2006.01)
*F04C 28/24* (2006.01)
(Continued)

(52) U.S. Cl.
CPC ..... *F04C 28/24* (2013.01); *F04B 49/243* (2013.01); *F04B 53/10* (2013.01); *F04C 29/026* (2013.01)

(58) Field of Classification Search
CPC ..... F04C 28/24; F04C 29/026; F04C 29/00; F04B 53/10; F04B 39/08; F04B 49/03;
(Continued)

(56) References Cited

U.S. PATENT DOCUMENTS 2,208,261 A * 7/1940 Jackson ..... G05D 16/0647 137/505.35
2,934,307 A * 4/1960 Henderson ..... F16K 31/126 251/355
(Continued)

FOREIGN PATENT DOCUMENTS

CN 101520103 A 9/2009
CN 102192152 A * 9/2011
(Continued)

OTHER PUBLICATIONS

International Search Report for PCT/IB2018/057628 dated Dec. 20, 2018.
(Continued)

*Primary Examiner* — Dominick L Plakkoottam
(74) *Attorney, Agent, or Firm* — Sughrue Mion, PLLC

(57) ABSTRACT

A minimum pressure valve (10) comprising a housing (17) with the valve inlet (11) and the valve outlet (12) connected with each other by a chamber and connecting space (22*a*, 22*b*), the minimum pressure valve (10) also comprising a valve body (21) set up in a chamber (20) moveably between a closed position in which the valve inlet (11) is closed and an open position in which the valve inlet (11) is open, the minimum pressure valve (10) also comprising components which are provided with a seal and/or sliding parts (24, 26, 30), whereby a subassembly (22) of the minimum pressure valve (10) can be disassembled and/or assembled through an opening (31) in the housing (17).

15 Claims, 5 Drawing Sheets

Figure 1:
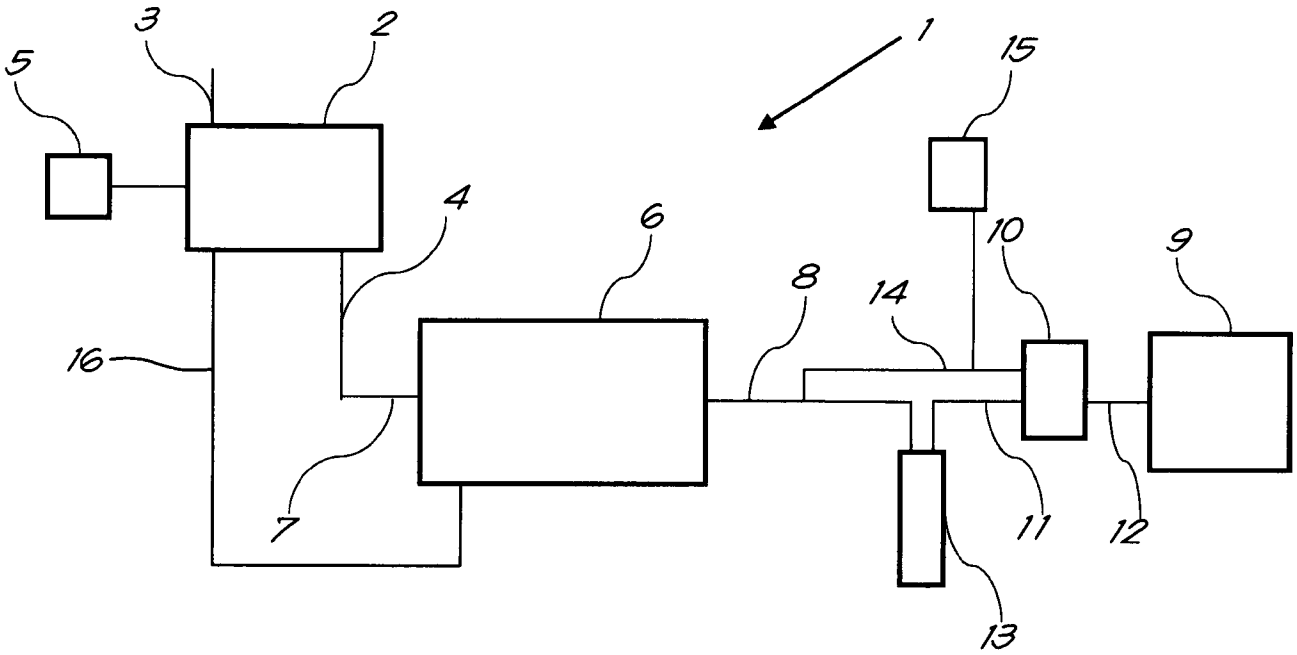

(51) Int. Cl.
*F04C 29/02* (2006.01)
*F04B 49/24* (2006.01)

(58) Field of Classification Search
CPC ..... F04B 39/10; F04B 27/1009; F04B 49/00; F04B 49/08; F04B 49/243
See application file for complete search history.

(56) References Cited

U.S. PATENT DOCUMENTS 3,347,259 A * 10/1967 Lansky ..... F15B 13/0431 137/269
3,526,246 A * 9/1970 Anton ..... F04B 53/10 137/516.13
4,172,466 A * 10/1979 Pattarini ..... F16K 31/383 137/488
4,362,475 A * 12/1982 Seitz ..... F04B 39/08 417/295
5,286,095 A * 2/1994 Sell ..... B60T 13/265 137/118.06
5,533,873 A * 7/1996 Kindl ..... F04C 18/16 417/295
5,540,558 A * 7/1996 Harden ..... F04C 28/24 417/295
8,789,557 B2 * 7/2014 Muller-Riederer ..... F16K 31/0655 137/493.9
2001/0046443 A1 * 11/2001 Van De Putte ..... F04C 29/021 417/44.2
2002/0155007 A1 * 10/2002 Virgilio ..... F04C 28/24 417/298
2006/0138378 A1 * 6/2006 Kay ..... G05D 16/107 251/339
2010/0219364 A1 * 9/2010 Martens ..... F16K 15/026 251/321

FOREIGN PATENT DOCUMENTS

| | | | |
|---|---|---|---|
| DE | 31 07 775 | A1 | 9/1982 |
| EP | 0 121 999 | A1 | 10/1984 |
| GB | 953755 | A | 4/1964 |
| GB | 2 150 266 | A | 6/1985 |
| WO | 2009/117788 | A1 | 10/2009 |
| WO | 2014/183173 | A1 | 11/2014 |

OTHER PUBLICATIONS

Written Opinion for PCT/IB2018/057628 dated Dec. 20, 2018 [PCT/ISA/237].
Written Opinion of the International Preliminary Examining Authority [PCT/IPEA/408].

* cited by examiner

MINIMUM PRESSURE VALVE AND METHOD FOR SERVICING SUCH A VALVE

CROSS REFERENCE TO RELATED APPLICATIONS

This application is a National Stage of International Application No. PCT/IB2018/057628 filed Oct. 2, 2018, claiming priority based on Belgium Patent Application No. 2018/5203 filed Mar. 27, 2018.

The invention relates to a minimum pressure valve, particularly for use with a compressor installation.

It is known that compressor installations comprise a minimum pressure valve, often attached to the outlet of a pressure vessel that can help when separating liquid, such as oil in the case of an oil-injected compressor, from compressed gas exiting the compressor element.

By injecting a liquid, such as for example oil, in the element of the compressor during compression of the gas, the rise in temperature of the compressed gas can be controlled. The coolant is usually separated from the flow of compressed gas in a liquid separator, which is often integrated in a pressure vessel placed downstream from the compressor element. The coolant is then usually recycled and returned from the pressure vessel or liquid separator, through a cooler, to the compressor element.

As the coolant flows through the cooling circuit, the pressure of the coolant will reduce. In order to ensure that the pressure of the coolant remains sufficiently high to be reinjected into the compressor element, the pressure in the pressure vessel must be kept at a sufficiently high level.

A minimum pressure valve ensures that, while loading the compressor installation, the pressure in the pressure vessel never drops below a certain minimum level. This minimum value is known as the 'setpoint' of the minimum pressure valve.

The setpoint is chosen in such a way that the injection of coolant is always guaranteed whatever the circumstances. This means that, even during temporary conditions, the pressure remains sufficiently high to prevent peaks in temperature. The setpoint is also chosen so that the flow rate through the pressure vessel or the liquid separator is not too high, more specifically that the flow rate through the (coalescence) filter placed in the liquid separator or in a pressure vessel after the liquid separator is not too high so as to prevent damage to this component.

In addition a non-return valve is usually fitted in the minimum pressure valve. This non-return valve ensures that the user network connected to the compressor remains pressurised when the compressor is stopped or operates without a load, so that no energy is lost from the user network.

Such minimum pressure valves are used in the industry, such as for example described in CN 101,520,103 A.

There are, however, certain problems related to minimum pressure valves.

A minimum pressure valve requires maintenance from time to time. More particularly in the course of time there is wear on the slide rings in the piston and/or the stem of the valve, and/or the seals, if present. Such wear can cause air leaks, which can disrupt the pressure and/or intended pressure balance on the moveable parts and can cause the valve to operate incorrectly. In the worst case, some moveable parts can become jammed, causing the valve to operate ineffectively.

For this reason the slide rings and/or seals are replaced regularly, for example in combination with other maintenance to the compressor, such as an oil change, new inlet filter, oil filter, etc. For an oil-injected compressor this may for example be after every 8000 hours of operation.

In order to replace the slide rings and/or the seals the technician first dismantles the minimum pressure valve. The minimum pressure valve inlet is usually attached to the top of the oil separation vessel and connected to the exit of the oil separation vessel, where the air, after being separated from most of the oil, leaves the oil separation vessel. The outlet of the minimum pressure valve is usually connected to the aftercooler. Both connections can be made either directly or with additional pipes. The connections are generally made with a bolted flange or more flexible connection.

The technician will detach the outlet of the minimum pressure valve from the aftercooler, also often removing the pipes between the minimum pressure valve and the aftercooler, and then detach the minimum pressure valve on the side of the exit of the oil separation vessel and finally remove the minimum pressure valve from the compressor. It is clear that much work is involved in dismantling the minimum pressure valve.

Depending on the size of the minimum pressure valve, the weight of the minimum pressure valve can be considerable. It is not unusual for the minimum pressure valve to weigh more than 20 kg. However, the technician does not always have lifting equipment on site and, even with lifting equipment, it is a challenge to remove the minimum pressure valve from the middle of the compressor. The technician often works alone and has no colleague available to lend a hand. Therefore, in many cases the technician will remove the minimum pressure valve himself by hand. This is not ideal from an ergonomic point of view and can even be dangerous.

The technician will then take the minimum pressure valve to a place where it can be checked. This may be in a workshop, if available, in his company vehicle or sometimes simply in an open space on the floor. In any case the technician must take the minimum pressure valve to a suitable location. Sometimes the technician will have a trolley available to transport the minimum pressure valve, but he will often just carry the minimum pressure valve himself. Again, this is not ideal from an ergonomic point of view.

The technician will then dismantle the minimum pressure valve, replace the slide rings and/or seals and reassemble the minimum pressure valve. The technician will therefore put the minimum pressure valve back in the compressor, again with all the same inconveniences as mentioned above.

It is clear that the maintenance of the minimum pressure valve is time consuming, often not very ergonomic and sometimes even dangerous.

An additional problem is that, after dismantling the minimum pressure valve, the exit of the oil separation vessel is exposed (particularly when the minimum pressure valve is mounted directly on the oil separation vessel). Dirt and moisture can enter the vessel and oil circuit, causing a variety of possible consequences, ranging from minor (dirt in the oil filter) to major (for example more rapid failure of the bearings in the compressor element). What can also happen is that objects, such as nuts or bolts, fall into the oil separation vessel. Attempts to remove these from the oil separation vessel are often complicated, but may be necessary as the technician often has no extra spare parts and furthermore it is essential to avoid at all costs that objects remain in the oil separation vessel.

The technician can prevent all such occurrences by temporarily sealing the exit of the oil separator, but this requires extra tools and work.

The purpose of the present invention is to provide a solution to at least one of the aforementioned and other disadvantages.

An aim of the present invention is to provide a minimum pressure valve whereby the repair or maintenance is less time consuming, more ergonomic, less dangerous and there is less exposure to dirt and other contamination during maintenance.

The present application therefore concerns an improved design of a minimum pressure valve.

To this end the invention relates to a minimum pressure valve consisting of a housing with a valve inlet and a valve outlet which are connected with other by way of a connecting space; the minimum pressure valve also comprises a valve body that is placed in a chamber moveably between, on the one hand, a closed position in which the valve inlet is sealed and on the other hand, an open position in which the valve inlet is open; the minimum pressure valve also comprises components provided with a seal and/or sliding parts, whereby a subassembly of the minimum pressure valve can be assembled and/or disassembled through an opening in the housing.

Preferably said subassembly of the minimum pressure valve can be assembled and/or disassembled through an opening in the side wall in the housing of the minimum pressure valve.

In a preferred embodiment of a minimum pressure valve according to the invention, the subassembly typically comprises the components which are provided with a seal and/or sliding parts, such as sealing rings and/or slide rings.

The advantage is that the sealing and/or sliding parts that are exposed to wear and/or aging can easily be checked and, if necessary, replaced without the hard work and time loss involved in dismantling the entire minimum pressure valve.

In addition, the subassembly of the minimum pressure valve that is removed weighs considerably less than the entire minimum pressure valve, whereby its removal and replacement can be done much more ergonomically. All other manipulations of the subassembly are therefore also much more simple and practical.

A further advantage is that, to seal the connection between the minimum pressure valve and the oil separation vessel and/or the aftercooler (or pipe leading to the oil separation vessel and/or the aftercooler), seals can be used that do not need to be suited for reuse, since they no longer need to be broken. This means that seals made of metal glue or flat seals can also be used, which may be cheaper and/or last longer.

Yet another advantage is that the connection with the oil separation vessel and/or the aftercooler is at least partly covered when the subassembly of the minimum pressure valve is removed.

In a first embodiment of a minimum pressure valve according to the invention, the opening in the side wall of the housing of the minimum pressure valve is covered with a lid.

This lid is preferably attached with bolts or another type of fastener that can be detached and then reattached.

Preferably a seal is placed between the lid and the housing of the minimum pressure valve in order to guarantee air tightness.

In another preferred embodiment of a minimum pressure valve according to the invention the subassembly with the components which are provided with a seal and/or sliding parts can pass through the opening in the side wall of the housing of the minimum pressure valve.

In yet another preferred embodiment of a minimum pressure valve according to the invention, the subassembly with the components which are provided with a seal and/or sliding parts can be fixed within the minimum pressure valve, for example using clamps or another fastener suitable for detachment and then reattachment.

The advantage is that the connection with the oil separation vessel remains at least partly covered thus reducing the risk of penetrating dirt and/or moisture or other objects entering/falling into the oil separation vessel.

Preferably, the subassembly with the components which are provided with a seal and/or sliding parts has a specific shape, so that it can only fit into the housing of the minimum pressure valve in one particular manner.

In a second embodiment of a minimum pressure valve according to the invention, the lid and the subassembly with the components which are provided with a seal and/or sliding parts, are connected, so that the subassembly with the components which are provided with a seal and/or sliding parts can be removed together with the lid.

Preferably, the subassembly with the components which are provided with a seal and/or sliding parts and/or the lid, can be equipped with extra functions to aid manipulation, such as a handle on the lid.

Another example is extra legs/extensions on the subassembly with the components which are provided with a seal and/or sliding parts, so that the subassembly can be placed in a stable manner on a surface, allowing the technician easy access for inspection and/or revision.

In another embodiment of a minimum pressure valve according to the invention, the subassembly with the components which are provided with a seal and/or sliding parts can be equipped with a connection, so that a particular air pressure can be applied to the components, for example a particular pressure exerted on the piston.

In a first embodiment of such a connection, this connection can be connected to a connection in the housing of the minimum pressure valve.

In a particular embodiment of such a connection this could be a connection, realised by clamping the subassembly with the components which are provided with a seal and/or sliding parts against the housing, whereby an outlet in the housing is connected with an inlet on the subassembly, whereby preferably the connection also has a seal that is suitable for a particular tolerance and for ensuring the air tightness.

In a second embodiment of such a connection, this connection can be connected to a connection in the housing of the minimum pressure valve via a flexible pipe and screw or using a bayonet catch.

In a third embodiment of such a connection according to the invention, this connection can be integrated in the lid connected with the subassembly with the components which are provided with a seal and/or sliding parts, so that after assembling the subassembly with the lid, an external flexible pipe can be connected to the lid opening in order to provide air pressure to the subassembly with the components which are provided with a seal and/or sliding parts.

In a second aspect the invention relates to a compressor comprising a compressor element with a gas inlet and an outlet for compressed gas, the compressor also comprising a pressure vessel with an inlet connected to the outlet for compressed gas, whereby a minimum pressure valve, such as described above, is provided directly or at a certain distance (using an intermediate connection piece) on an outlet of the pressure vessel, the minimum pressure valve being connected with the valve inlet to the outlet of the pressure vessel and the valve outlet being adapted to be connected to a user network, whereby the minimum pressure valve comprises a housing whereby the valve inlet and the valve outlet are connected by means of a chamber and connecting space, the minimum pressure valve also comprises a valve body that is placed in a chamber moveably between a closed position in which the valve inlet is closed and an open position in which the valve inlet is open, whereby a part (the subassembly) of the minimum pressure valve comprising the components which are provided with a seal and/or sliding parts, such as sealing rings and/or slide rings can be disassembled and/or assembled through an opening in the housing, preferably in the side wall of the housing.

The compressor is preferably a liquid or oil-injected compressor.

In a third aspect the invention relates to a method for servicing a minimum pressure valve of a compressor such as described above, the compressor comprises a compressor element with a gas inlet and an outlet for compressed gas, the compressor also comprises a pressure vessel with an inlet connected to the compressed gas outlet, whereby a minimum pressure valve, such as described above, is provided directly or at a certain distance (using an intermediate connection piece) on an outlet of the pressure vessel, the minimum pressure valve comprises the valve inlet connected to the outlet of the pressure vessel and the valve outlet is adapted to be connected to a user network, whereby the minimum pressure valve comprises a housing whereby the valve inlet and the valve outlet are connected by means of a chamber and connecting space; the minimum pressure valve also comprises a valve body placed in a chamber moveably between a closed position in which the valve inlet is closed and an open position in which the valve inlet is open, whereby a subassembly of the minimum pressure valve that comprises the components which are provided with a seal and/or sliding parts, such as sealing rings and/or slide rings can be disassembled and/or assembled through an opening in the housing, preferably in the side wall of the housing, the subassembly comprises the components which are provided with a seal and/or sliding parts to replace said seal and/or slide rings.

The method comprises the following steps: a) detaching the bolts (or other fasteners) from the subassembly, b) removing the subassembly, for example using the handle, from the opening in the minimum pressure valve, c) removing the valve body, d) replacing the seal(s) and slide ring(s), e) removing the non-return valve and replacing the slide ring(s), f) reassembling the non-return valve and the valve body, g) tightening the bolts of the subassembly on the housing of the minimum pressure valve.

In the context of the present invention it should be understood that the above advantages related to the minimum pressure valve also apply to the compressor and the method.

Figure 2:
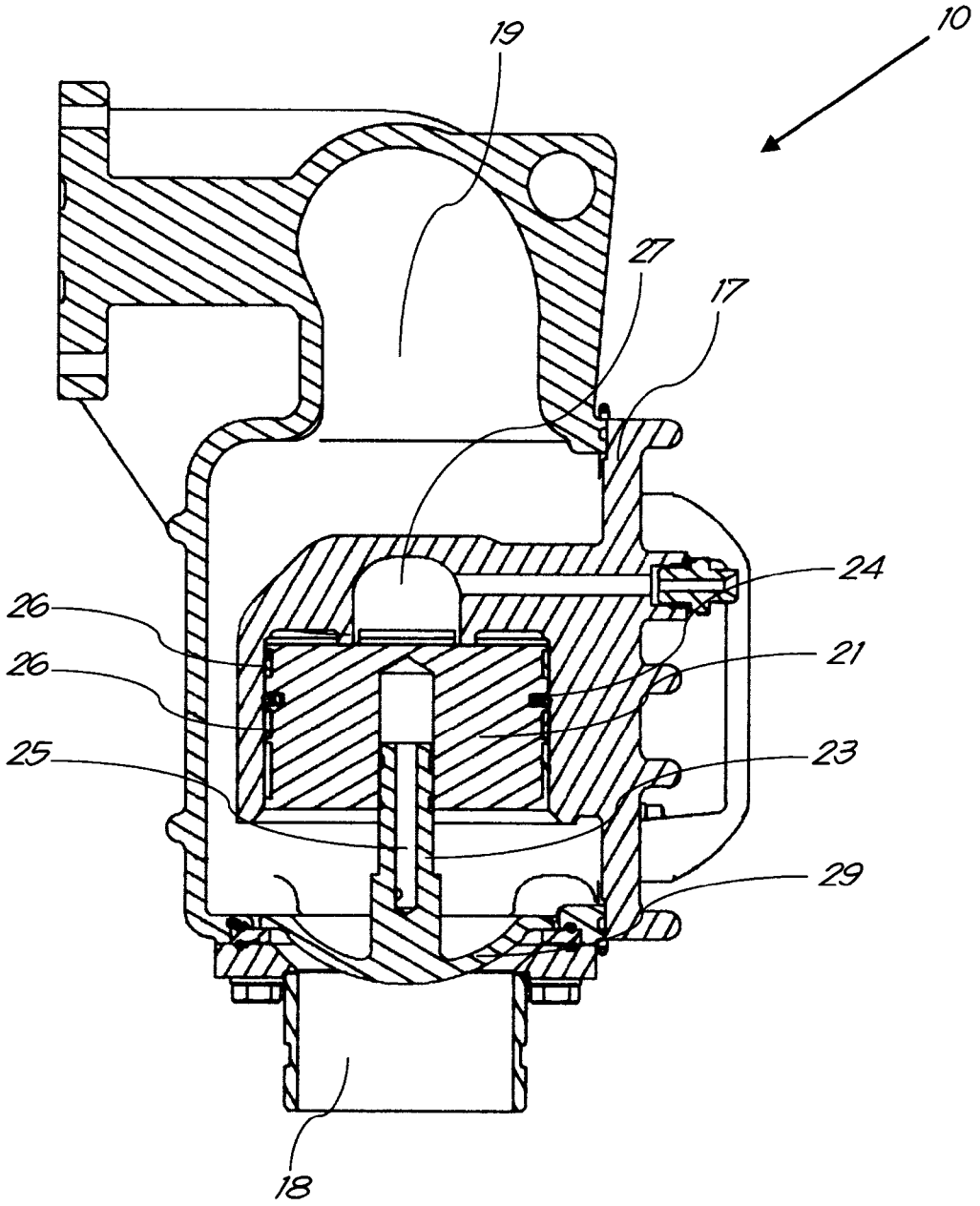
Figure 3:
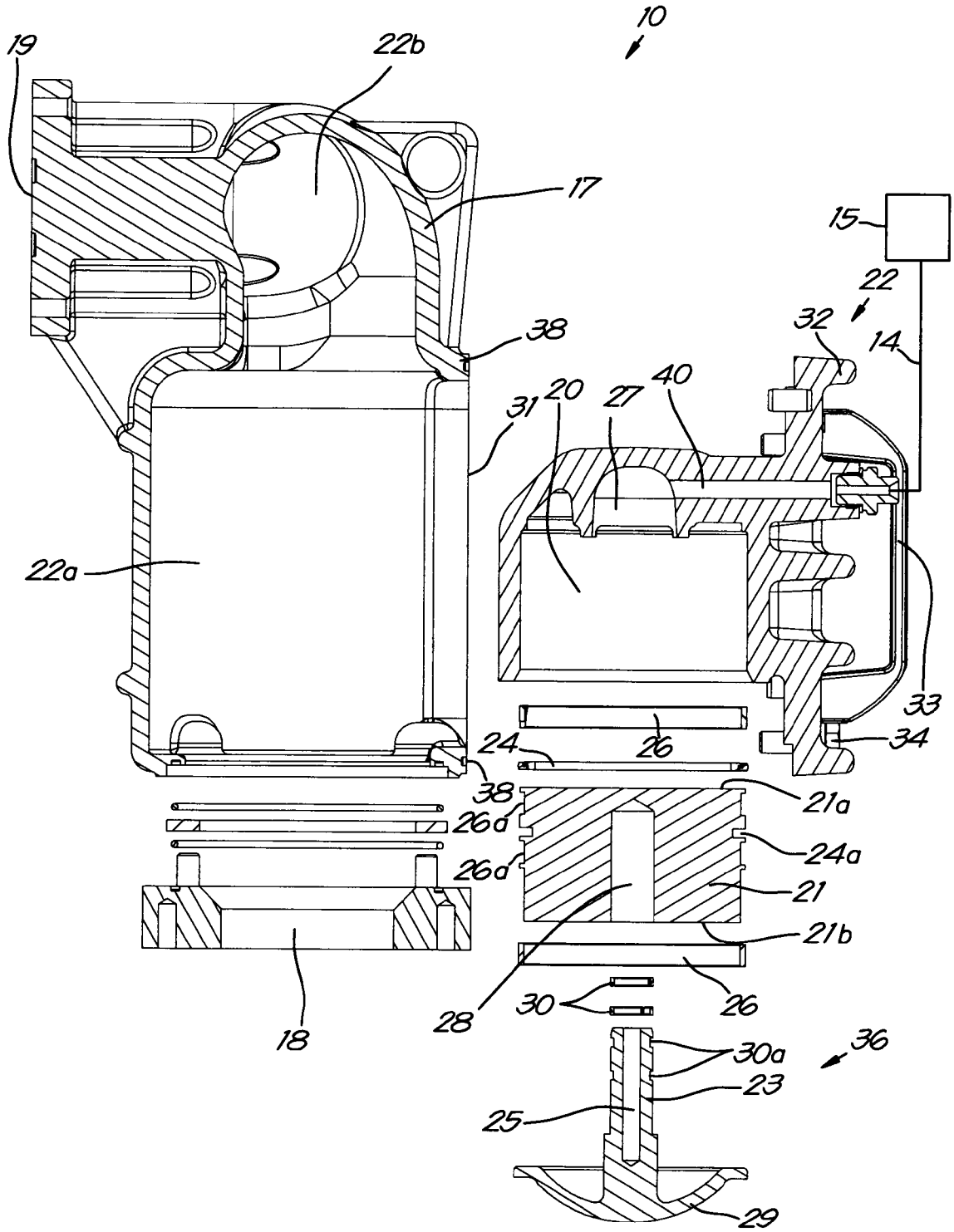
Figure 4:
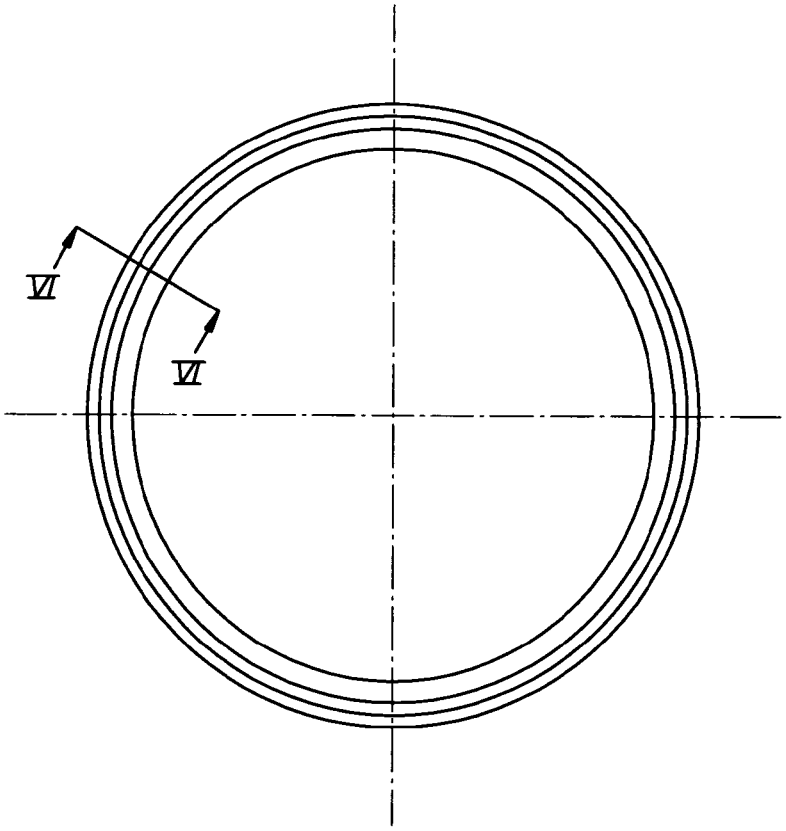
Figure 5:
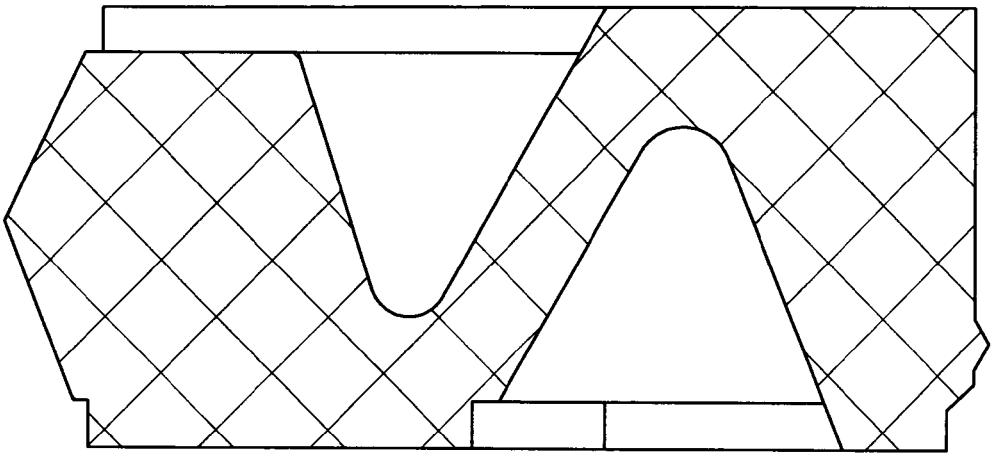
Figure 6:
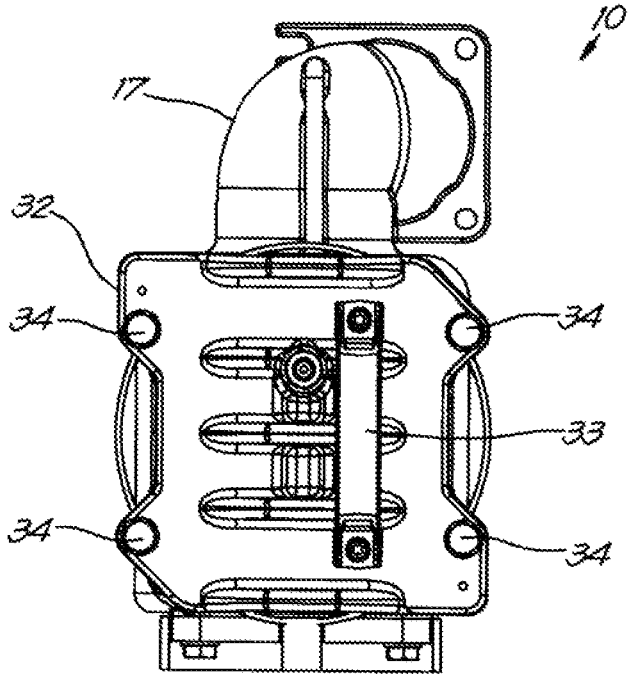
Figure 7:
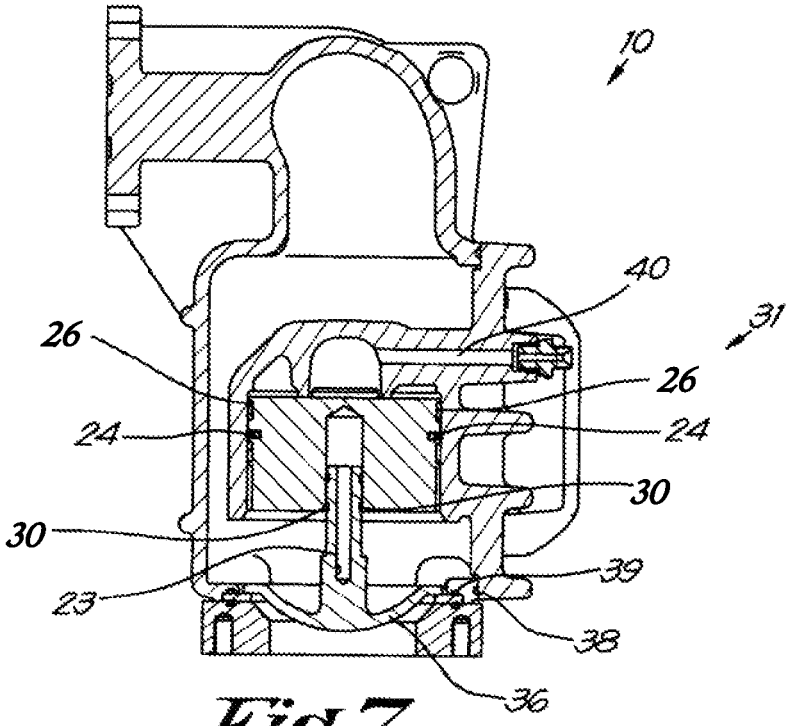

With the intention of better showing the characteristics of the invention, a preferred embodiment of a minimum pressure valve according to the invention is described hereinafter, by way of an example without any limiting nature, with reference to the accompanying drawings, wherein:

FIG. 1 schematically shows a compressor according to the invention;

FIGS. 2 and 3 schematically show a cross-section of a minimum pressure valve of an embodiment according to the invention;

FIGS. 4 and 5 schematically illustrate a seal that can be used with the minimum pressure valve according to the invention; and FIGS. 6 and 7 schematically show a view and cross-section of a minimum pressure valve according to a preferred embodiment of the invention.

FIG. 1 illustrates a compressor 1 consisting of a compressor element 2 with a gas inlet 3 and a compressed gas outlet 4. The compressor 1 is usually driven by a fixed or variable-speed motor 5.

The compressor element 2 must be interpreted as the housing in which the compressor process takes place by means of a rotor or via a piston compressor movement.

The compressor 1 comprises a pressure vessel 6 with an inlet 7 connected to the compressed gas outlet 4 and an outlet 8 connected to a user network 9. This pressure vessel 6 is also known as a liquid separator, because it is inside this vessel that the air is separated from most of the liquid. The separated liquid is then returned to the compressor element via the return pipe 16.

The compressor 1 also comprises a (coalescence) filter which is either mounted in the liquid separator 6, or in a separate pressure vessel 13 after the liquid separator 6.

A minimum pressure valve 10 is provided at the outlet 8, on the liquid pipe provided between the pressure vessel 6 and the user network 9.

The minimum pressure valve 10 has a valve inlet 11 connected to the outlet 8 of the pressure vessel 6 and a valve outlet 12 adapted to be connected to a user network 9.

A pipe 14 connects the outlet 8 of the pressure vessel 6 with the pressure control entry of the minimum pressure valve 10; in this pipe a control unit 15 is provided which regulates the pressure supply via the supply pipe 14.

FIGS. 2 and 3 show a cross-section of a minimum pressure valve 10 according to the invention.

The minimum pressure valve 10 comprises a housing 17 with a housing inlet 18, a housing outlet 19, a chamber 22*a* for receiving a removable subassembly 22 and a connecting space 22*b* between the chamber 22*a* and the housing outlet 19.

The housing inlet 18 is brought in fluid connection with the valve inlet 11 and the housing outlet 19 is brought in fluid connection with the valve outlet 12 when the minimum pressure valve is mounted within the compressor 1.

The minimum pressure valve 10 comprises a valve body 21 that is moveable in a chamber 20 between a closed position in which the valve inlet 11 is closed and an open position in which the valve inlet 11 is opened.

When the valve inlet 11 is closed, no or practically no liquid is allowed to flow through the minimum pressure valve 10, thus from the housing inlet 18 to the housing outlet 19 and further towards the user network 9.

Considering that, when the valve inlet 11 is open, liquid is allowed to flow through the minimum pressure valve 10, from the housing inlet 18 to the housing outlet 19 and further reaching the user network 9.

The pressure which determines whether the valve body 21 moves to an open position, is determined by a control unit 15.

In commonly used minimum pressure valves 10, a spring is used to set the pressure value whereby the minimum pressure valve is opened and such a spring is selected to suit the capacity and the pressure range of the compressor 1.

In the embodiment of the figures a control unit 15 replaces said spring, hereby avoiding the need for components which would be difficult to fit or replace as described in BE 2018/5011.

The control unit 15 comprises a pipe 14 which forms a connection between the outlet 8 of the pressure vessel 6 and a space contained between the valve body 21 and the chamber 20.

The channel 40 will be used to transport air to a first end 21*a* of the valve body 21.

The chamber 20 comprises a groove 27 or recess above a first end 21*a* of the valve body 21.

Such a groove 27 creates a hollow space between the inside of the chamber 20 and the valve body 21 at the level of the first end 21*a*.

In the context of the present invention it should be understood that minimum pressure valves containing on the one hand a spring or on the other a control unit 15, are within the scope of the invention.

The valve body 21 comprises a seal 24 that is adapted to be mounted on the outer contour 24*a* of the valve body 21, thus between the valve body 21 and the internal side of the chamber 20.

The seal 24 is mounted between the first end 21*a* and the second end 21*b* of the valve body 21.

Such a seal 24 is therefore positioned so that there is a separation between on the one hand the space contained between the seal 24, the groove 27 and the first end 21*a*, whereby the pressure value is defined by the pressure of the liquid flowing through the channel 40, and on the other hand the space contained between the seal 24, the second end 21*b* and the connecting space in the housing 17 between the housing inlet 18 and the housing outlet 19, whereby the pressure value is defined by the pressure supplied to the housing inlet 18 in the case that the valve body is in the open position or by the relevant pressure in the valve outlet 19 in the case that the valve body is in the closed position.

Depending on the requirements for the minimum pressure valve 10, more than one seal 24 may be fitted, such as for example 2, 3 or more seals.

Preferably, a bi-directional seal is used. Such a seal will work in both directions. FIGS. 4 and 5 show a cross-section of such a seal.

Alternatively, two single-action seals can be used, placed back-to-back or front-to-front in series.

Although the figures show the seal placed around the valve body 21, it is also possible to place this in the housing 17 of the minimum pressure valve 10 by providing a groove in the chamber 20.

Preferably, but without limiting nature, these seals can be characterised by very low friction and little stick-slip.

The valve body 21 comprises a conductive element 26, adapted to be fitted on the outer contour 26*a* of the valve body 21, between the valve body 21 and the inside of the chamber 20.

Such a conductive element 26 reduces the wear on the valve body 21 and on the inside of the chamber 20. This wear is caused by the movement of the valve body 21 within the chamber 20 and the friction caused upon this.

One or more conductive elements can be provided. In addition the conductive elements 26 absorb the transverse forces that occur during the movement of the valve body 21 within the chamber 20. Consequently, these conductive elements 26 prevent the valve body 21 from tipping within the chamber 20 and subsequently becoming stuck in the chamber 20.

The seal 24 is fitted between two conductive elements 26. The conductive element 26 can be executed in the form of a seal, a slide ring or a conductive tape.

Although in the figures the conductive element 26 is placed around the valve body 21, it would also be possible to place this in the housing 17 of the minimum pressure valve 10 by providing a groove in the chamber 20.

The valve body 21 comprises a bore 28 in which the piston 23 of the non-return valve 36 is mounted. This non-return valve is moveable between a closed position in which the housing inlet 18 is closed and an open position in which the housing inlet 18 is opened.

In the piston 23 a channel 25 is provided to ensure that no air mounts up between the end of the piston 23 and the end of the internal bore 28 in the valve body 21 in which the piston 23 moves.

For a stable and balanced operation of the non-return valve the axis of the bore 28 is aligned or almost aligned with the axis of the valve body 21.

The step section 29 of the non-return valve 36 ensures a seal between the outlet 12 of the minimum pressure valve 10 and the outlet of the pressure vessel 6.

For a flowing movement between the piston 23 and the valve body 21 and for the protection of the piston 23 and the valve body 21 from the harmful effects of the friction that is caused upon it, the piston 23 also comprises a second conductive element 30 which is adapted so that this can be mounted in position 30*a* between the piston 23 and the valve body 21.

Although in the figures the second conductive element 30 is placed around the piston 23, it would also be possible to place this in the valve body 21 of the minimum pressure valve 10 by providing a groove in the central bore 28 of the valve body 21.

Depending on the design the minimal pressure valve 10 can consist of some or even all technical characteristics and functions mentioned herein and in any desired combination thereof. 'Technical characteristics and functions' refers here to: all components of the compressor 1 and the control unit 15 (can also be replaced with a spring), the pipe 14, the valve body 21, the channel 25, the piston 23, the seal 24, the conductive unit 26, the groove 27, the step section 29 and the second conductive unit 30. These functions do not all need to be present.

As indicated in the FIGS. 2, 3, 6 and 7, part of the minimum pressure valve 10 is removable (the subassembly 22) through an opening 31 in the housing 17; we call this removable part the subassembly. Subassembly refers here to: the lid 32, the valve body 21, the seal 24, the conductive unit 26, the piston 23, the step section 29 and the second conductive unit 30. These components do not all need to be present.

The subassembly has an integrated cover plate or lid 32 which covers the opening 31 in the housing 17 of the minimum pressure valve 10, preferably in the side wall of the housing 17. An optional handle 33 used to easily remove the subassembly is fixed to the outside of the lid 32.

The subassembly is attached to the outside of the housing 17 of the minimum pressure valve 10 with the help of four bolts 34.

In addition, the subassembly, which can be taken out of the minimum pressure valve 10, is provided with a connection 40 so that a particular air pressure can be applied to the components.

Servicing of the minimum pressure valve 10, according to the invention, is carried out as follows:

First the four bolts 34 on the subassembly and the connection of the pressure supply pipe coming from the control unit 15 on the connection 40 in the housing 17 are detached. Next the subassembly is taken out of the housing 17 using the handle 33. Then the valve body 21 is taken out of the chamber 20.

The seal 24 and the two slide rings 26 are now easily accessed for replacement.

The non-return valve 36 (including the piston 23) is taken out of the valve body 21 whereby the two slide rings 30 can be replaced.

The piston 23 and the non-return valve 36 are mounted in the valve body 21 using self-alignment; the same occurs with the valve body 21 in the chamber 20.

Finally the four bolts 34 on the subassembly are tightened on the housing 17 of the minimum pressure valve 10, and the pressure supply pipe coming from the control unit 15 is reattached to the connection 40 in the housing 17.

In the example shown a seal 38 is provided between the lid 32 and the housing 17 of the minimum pressure valve 10 in order to guarantee air tightness. This seal 38 will also be easily accessed for replacement when the subassembly is removed from the housing 17 using the handle 33.

The present invention is by no means limited to the embodiment described as an example and shown in the drawings, but a minimum pressure valve, compressor and method according to the invention as defined by the claims, can be realised in all kinds of variants without departing from the scope of the invention.

The invention claimed is:

1. A minimum pressure valve (10) comprising:

a main housing (17) with a housing inlet (18) and a housing outlet (19) connected with each other by a housing chamber (22*a*) and connecting space (22*b*), said main housing having an opening (31) therein;

a sub-assembly including:

a valve housing having a valve chamber (20) formed therein, a valve body (21) fully provided in the valve chamber (20) and including a valve (36) with a closing portion (29) movable between a closed position in which the housing inlet (18) is closed off by the closing portion (29) and an open position in which the housing inlet (18) is open, and a seal provided on the valve body and contacting a wall of the valve chamber to create a seal between the valve body and the wall of the valve chamber, wherein the sub-assembly is removably provided in the housing chamber (22*a*) so as to be disassembled and/or assembled through the opening (31) in the main housing (17), and wherein the sub-assembly (22) has a specific shape so that it can only fit in the main housing (17) of the minimum pressure valve (10) in one particular way.

2. A minimum pressure valve (10) according to claim 1, wherein the opening (31) is located in a side wall of the main housing (17) of the minimum pressure valve (10) and is a separate opening from the housing inlet (18).

3. A minimum pressure valve (10) according to claim 1, wherein said sub-assembly (22) comprises both the seal and a slide ring provided on the valve body.

4. A minimum pressure valve (10) according to claim 1, wherein the sub-assembly further includes a lid (32) integral with the valve housing for closing the opening.

5. A minimum pressure valve (10) according to claim 4, wherein said lid (32) is mounted on the main housing (17) with bolts (34) or another type of fastener that can be detached and then reattached.

6. A minimum pressure valve (10) according to claim 4, wherein a lid seal (38) is provided between the lid (32) and the main housing (17).

7. A minimum pressure valve (10) according to claim 1, wherein the sub-assembly is removable as a single unit.

8. A minimum pressure valve (10) according to claim 4, wherein the sub-assembly further includes a handle (33) on the lid (32), in order to facilitate handling.

9. A minimum pressure valve (10) according to claim 4, wherein the subassembly (22) is provided with a connection (40) so that a particular air pressure can be applied to at least one component of the sub-assembly.

10. A minimum pressure valve (10) according to claim 9, said connection (40) is integrated in the lid (32).

11. A compressor (1) comprising a compressor element (2) with a gas inlet (3) and an outlet (4) for compressed gas, the compressor (1) also comprising a pressure vessel (6) with an inlet (7) connected to the outlet (4) for compressed gas, whereby the minimum pressure valve (10) according to claim 1 is provided on an outlet (8) of the pressure vessel (6), the minimum pressure valve (10) being connected with the housing inlet (18) to the outlet (8) of the pressure vessel (6) and the housing outlet (19) being adapted to be connected to a user network (9).

12. The compressor (1) according to claim 11, wherein the compressor is a liquid or oil-injected compressor.

13. A method for servicing a minimum pressure valve (10) of a compressor (1), the compressor (1) comprising a compressor element (2) with a gas inlet (3) and an outlet (4) for a compressed gas, the compressor (1) also comprising a pressure vessel (6) with an inlet (7) connected to the outlet (4) for compressed gas, whereby the minimum pressure valve (10) according to claim 1 is provided on an outlet (8) of the pressure vessel (6), the minimum pressure valve (10) is connected with the housing inlet (18) to the outlet (8) of the pressure vessel (6) and the housing outlet (19) is adapted to be connected to a user network (9), wherein the method comprises removing the sub-assembly through the opening (31) in the main housing (17).

14. The method according to claim 13, further comprising the following steps:

detaching bolts (34) connecting the sub-assembly to the main housing (17), removing the subassembly (22) from the opening (31) in the main housing (17), removing the valve body (21) from the valve housing, replacing the seal provided on the valve body, removing the valve (36) from the valve body and placing a slide ring on the valve body, reassembling the valve (36) and the valve body (21), tightening the bolts (34) of the sub-assembly (22) on the main housing (17) of the minimum pressure valve (10).

15. The minimum pressure valve (10) according to claim 1, wherein the opening is on a side of the main housing (17) and the housing inlet (18) is on a top side of the main housing (17).

* * * * *